United States Patent [19]

Rogers

[11] Patent Number: 5,012,604

[45] Date of Patent: May 7, 1991

[54] TRIGGER ASSEMBLY

[76] Inventor: Laurence B. Rogers, 502 N. Ridgeway, Sapulpa, Okla. 74066

[21] Appl. No.: 499,799

[22] Filed: Mar. 27, 1990

[51] Int. Cl.[5] ..... F41A 19/16

[52] U.S. Cl. ..... 42/69.03; 89/139

[58] Field of Search ..... 42/69.03, 69.02, 69.01, 42/DIG. 1; 89/139

[56] References Cited

U.S. PATENT DOCUMENTS

| | | | |
|---|---|---|---|
| 2,377,338 | 6/1945 | Garand | 42/22 |
| 2,399,253 | 4/1946 | Reilly | 89/139 |
| 2,464,418 | 3/1949 | Sefried, II | 89/139 |
| 2,550,280 | 4/1951 | Martin et al. | 89/139 |
| 2,590,862 | 4/1952 | Hoppert | 42/69.01 |
| 2,873,650 | 2/1959 | Pinkerton, Jr. | 89/131 |
| 2,984,037 | 5/1961 | Wilhelm | 42/69.03 |
| 3,377,731 | 4/1968 | Lawrence | 42/69.01 |
| 4,109,402 | 8/1978 | Guardamino | 42/69.01 |
| 4,151,670 | 5/1979 | Rath | 42/69.03 |

*Primary Examiner*—Michael J. Carone
*Attorney, Agent, or Firm*—Robert E. Massa

[57] ABSTRACT

A trigger assembly for a gun comprises a trigger, a hammer mounted adjacent the trigger, a spring-biased member urging the hammer into a firing position, a sear on the trigger to hold the hammer in a cocked position, an auxiliary sear mounted on the trigger to engage the hammer in event the hammer is urged into a cocked position before the trigger is released, an adjustable spring-biased member attached to the auxiliary sear to permit adjustment of the auxiliary sear, and an adjustable elongated spring-biased component positioned longitudinally adjacent a lower portion of the trigger assembly and having one end impinging a front lower face of the trigger to permit fine adjustment of trigger movement. The adjustable spring-biased member attached to the auxiliary sear includes a hook member removably positioned upon the auxiliary sear, a threaded adapter positioned in the lower portion of the trigger assembly, and a spring connecting the hook member to the threaded adapter. The threaded adapter includes a threaded outer member positioned adjacent the trigger assembly and a threaded bolt received cooperatively in the threaded outer member. The cooperation of the components provides adjustment of the trigger tension and adjustment or reduction in the amount of creep in the trigger mechanism.

17 Claims, 2 Drawing Sheets

TRIGGER ASSEMBLY

FIELD OF THE INVENTION

My invention relates to firearms, and more particularly, relates to trigger assemblies for semi-automatic firearms. Still more particularly, my invention relates to adjustable trigger assemblies for firearms, such as semi-automatic rifles.

BACKGROUND OF THE INVENTION

Semi-automatic firearms, such as semi-automatic rifles, are described as being "semi-automatic" because the firing is done by a trigger and hammer mechanism in a manner that a new cartridge, or round, is loaded into the firing chamber from a clip contained within the rifle by action of the firing mechanism after each shot without the need for the rifleman to operate a loading device or lever. With the semi-automatic operation, the gun is cocked, ready for the next shot, which may then take place only upon the next pull of the trigger. The trigger must be pulled to fire each shot. In an automatic weapon, the gun will automatically load and fire each succeeding round as long as the trigger is held in the firing position.

The most widely-known semi-automatic rifle has been the U.S. .30 caliber M-1 rifle, or Garand, invented by John C. Garand, and described in his U.S. patents.

The Garand rifle, as with any other mechanical device, includes all its parts manufactured within certain tolerance limits. As a result, each rifle is minutely different in operation of the firing mechanism, particularly in the action of the trigger in what is commonly referred to as "creep".

"Creep" refers to the movement of the trigger just before firing. An undesirable amount of creep is responsible for a reaction by the rifleman for what is called "flinching", a nervous reaction by the rifleman to an anticipation of the instant of firing.

If a rifleman has had long experience with his own rifle, he will usually adjust intuitively to the action of his own rifle. Whereas, if the rifleman is given a different weapon of the same type of fire, he might experience a period of poor shooting because of his lack of familiarity with the different weapon. The "creep" might be slightly different and he might find himself instinctively flinching.

Normally, the rifleman is trained to ignore creep and to devote all his attention to the target, squeezing the trigger only when the target is lined up with the sights of the rifle, so that he will not be aware of the instant of firing.

In the Garand rifle as originally supplied, the trigger pull is indicated as being from 5½ to 7½ pounds. The typical trigger creep of the Garand is usually within the range of 0.01 to 0.02 inch.

Other devices have been invented to offer some control of trigger creep. I have found in the prior art the following U.S. patents for these various devices for adjusting trigger movement and for different forms of trigger mechanisms:

| | | |
|---|---|---|
| U.S. Pat. No. 2,377,338 | Garand | June 5, 1945 |
| U.S. Pat. No. 2,399,253 | Reilly | April 30, 1946 |
| U.S. Pat. No. 2,464,418 | Sefried, II | March 15, 1949 |
| U.S. Pat. No. 2,550,280 | Martin et al | April 24, 1951 |
| U.S. Pat. No. 2,590,862 | Hoppert | April 1, 1952 |

-continued

| | | |
|---|---|---|
| U.S. Pat. No. 2,873,650 | Pinkerton, Jr. | Feb. 17, 1959 |
| U.S. Pat. No. 3,377,731 | Lawrence | April 16, 1968 |
| U.S. Pat. No. 4,151,670 | Rath | May 1, 1979 |

The patent to Garand, U.S. Pat. No. 2,377,328, describes in detail the well-known firing mechanism of the M-1, or Garand, rifle.

Reilly, U.S. Pat. No. 2,399,253, describes a modified sear mechanism for the Garand rifle, intending to reduce "creep" by adjustment of the adjusting screw 13 mounted on the sear 12.

Sefried, II, U.S. Pat. No. 2,464,418, describes a fire-control mechanism combining with modified trigger components to provide a finger piece operable from the exterior of the fire-arm to permit the rifleman to operate the rifle as either a semiautomatic weapon or as an automatic weapon, as he chooses.

Martin et al, U.S. Pat. No. 2,550,280, describes another type of semi-automatic rifle.

Hoppert, U.S. Pat. No. 2,590,862, describes a trigger mechanism for a Garand rifle which is intended to substantially eliminate the amount of creep characteristic of the weapon. A spring is mounted in back of the primary sear and secured to the back of the trigger. The tension of the spring against the sear is adjusted by means of a screw acting against the rear of the spring.

Pinkerton, U.S. Pat. No. 2,873,650, describes a fluid-operated system adapted to a Grand rifle for converting the rifle to automatic firing.

Lawrence U.S. Pat. No. 3,377,731, describes a lever action system for a firearm.

Rath, U.S. Pat. No. 4,151,670, describes a firing mechanism for semi-automatic firearms which includes a safety device having an extension protruding inside the trigger guard to be felt by the shooter so that he may easily determine whether the gun is cocked or not cocked.

SUMMARY OF THE INVENTION

The primary object of my invention is to provide a trigger assembly which is simple, easy to manufacture, and inexpensive.

Another object of my invention is to provide a trigger assembly which is easily adjustable.

Still another object of my invention is to provide a trigger assembly which is adjustable from exteriorly of a firearm.

Still another object of my invention is to provide a trigger mechanism for a rifle which is easily adjustable from externally of the rifle.

Still another object of my invention is to provide a trigger mechanism for a rifle which may be easily adapted to a present trigger assembly of the rifle.

Still another object of my invention is to provide a trigger mechanism for a rifle which may be easily adjustable in adjustment of trigger movement.

Still another object of my invention is to provide a trigger mechanism for a rifle which may be finely adjusted to control trigger movement and creep.

In long experience with firearms, I have been aware that trigger mechanisms vary in their action or pull on the trigger. The trigger of an unmodified rifle might move from 0.01 inch to 0.02 inch before releasing the hammer. In the Garand rifle, a trigger lug engages a hook on the hammer when the rifle is in the cocked position, and holds the hammer in firing position against the tension of the spring which exerts pressure on the hammer in attempting to move the hammer into the firing position. It should be noted that Garand, in his U.S. Pat. No. 2,377,338, refers to the trigger lug which I have just described as "main sear 61."

Also, Garand describes another of his components as an "auxiliary sear 62", which others refer to as "primary sear", or, simply "sear". I prefer to use Garand's terminology, especially since Webster's Unabridged Dictionary defines a sear as "the catch that holds the hammer of a gunlock at cock or half cock".

I have designed and developed my trigger control mechanism for a rifle, particularly the Garand rifle, as a means for reducing the creep movement of a trigger and also as a means for adjusting and reducing the force needed to pull the trigger.

For instance, with my assembly, the creep movement of the trigger can be made as small as 0.009 inch, and the trigger pull can be reduced to less than 2.5 pounds.

I have designed my trigger control mechanism so that the component which adjusts the movement of the sear and the component which adjusts the pull needed to actuate the trigger can both be easily adjusted from exteriorly of the rifle without the need to disassemble the rifle. In the adjustment of either of these components, the fine adjustment provided by each is easily accomplished by rotation of a fine-threaded screw member.

For the achievement of expert marksmanship it is important that the rifleman be able to adjust the creep of the trigger and the pressure required to fire the trigger to the degree with which he feels most comfortable and competent. He adjusts the creep and pressure as he can consistently be most accurate in his firing.

I have accomplished the adjustment of the biasing of the auxiliary sear by removably connecting a spring-biased component to the auxiliary sear in a manner that the spring tension of this connecting member may be easily adjusted from outside the rifle. I have arranged a hook member to be attachable to the auxiliary sear. The hook member is attachable by a spring to a threaded outer member or sleeve member which is then received threadedly upon a bolt passing through an opening in the housing of the rifle. Then the bolt is easily rotatably adjusted from outside the housing by use of a screwdriver to fit into a slot in the head of the bolt. As the bolt is rotated, the outer member moves either up or down on the bolt to ease or increase the tension of the spring on the hook positioned on the auxiliary sear.

Then, to cooperate in the adjustment of the positioning or tension on the trigger, I have provided an elongated spring-biased component positioned longitudinally within the housing and adjacent a lower side of the housing and having a first end bearing against an inner surface of the front plate of the trigger assembly and having a second end bearing against a front lower face of the trigger. Thus, the first end which bears against the front plate impinges against a stable component. The second end which bears against the front lower face of the trigger impinges against the rotatable trigger, at a position below the rotatable connection of the trigger with the trigger housing, thus the force urging the trigger rearwardly is adjustable and accomplishes the adjustment of the amount of creep of the trigger and the fine adjustment of the force of the trigger pull.

The elongated spring-biased component I have designed for this purpose includes an elongated threaded member cooperating with a threaded sleeve near a first end of the elongated component so that the threaded portions may cooperate to provide for the fine adjustment of the elongated member. A second end portion of the elongated member cooperates with a pin member securable thereon. The pin member includes an enlarged portion adjacent the second end which impinges against the front face of the trigger, and thus permits a surface larger than the original cylindrical surface of the pin to bear against the trigger.

A coil spring encircles the elongated member near the end between the threaded sleeve and the front plate so that the coil spring may bear against the inner surface of the front plate and the tension of the coil spring against the front plate may be adjusted by the adjustable rotatable movement of the threaded sleeve. In this manner the tension against the trigger may be finely adjusted. The elongated member also includes a first end which is slidably movable within and through an opening in the front plate in order to permit the coil spring to exert tension against the front plate. Adjustment of the threaded sleeve may be achieved by the insertion of a sharp-pointed tool through an opening in the bottom plate of the housing directly below the threaded sleeve and exerting rotating movement to the threaded sleeve. Slight rotatable movement of the threaded sleeve will adjust the tension of the coil spring.

The above objects and advantages of my invention will become apparent from my description of the following preferred embodiments of my invention.

DESCRIPTION OF THE PREFERRED EMBODIMENTS

Figure 1:
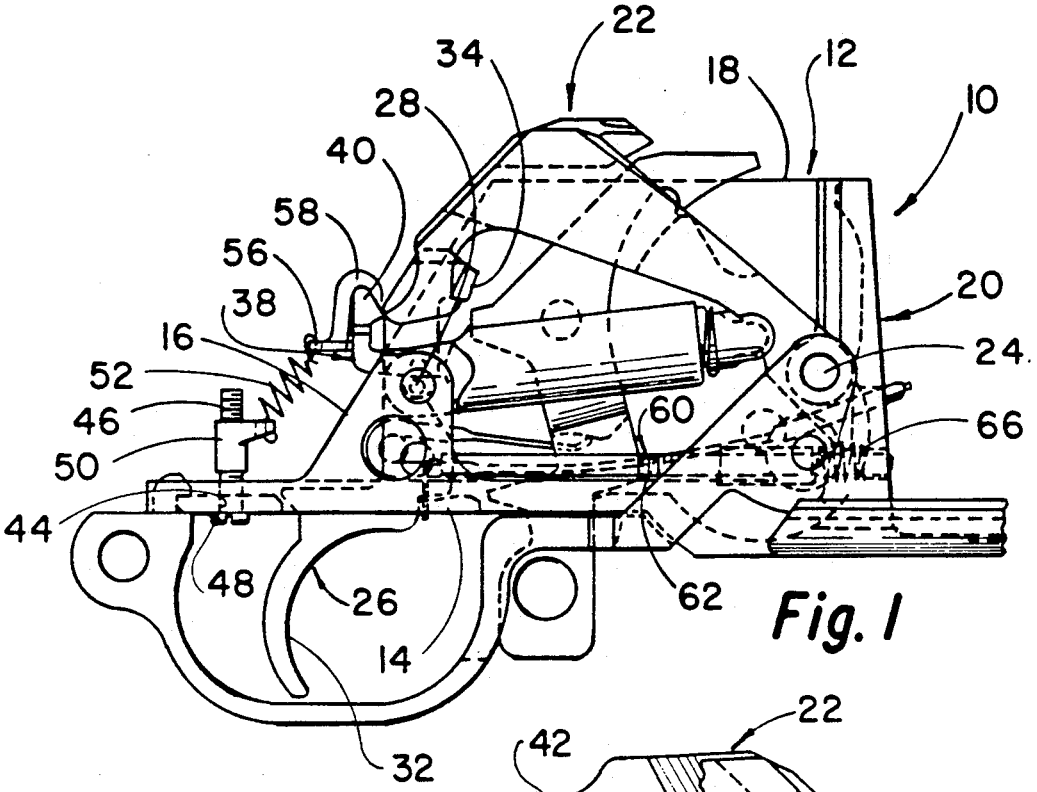
FIG. 1 is a side elevational view, partly in section and partly fragmentary, of a trigger mechanism in cocked position, embodying my invention.
Figure 2:
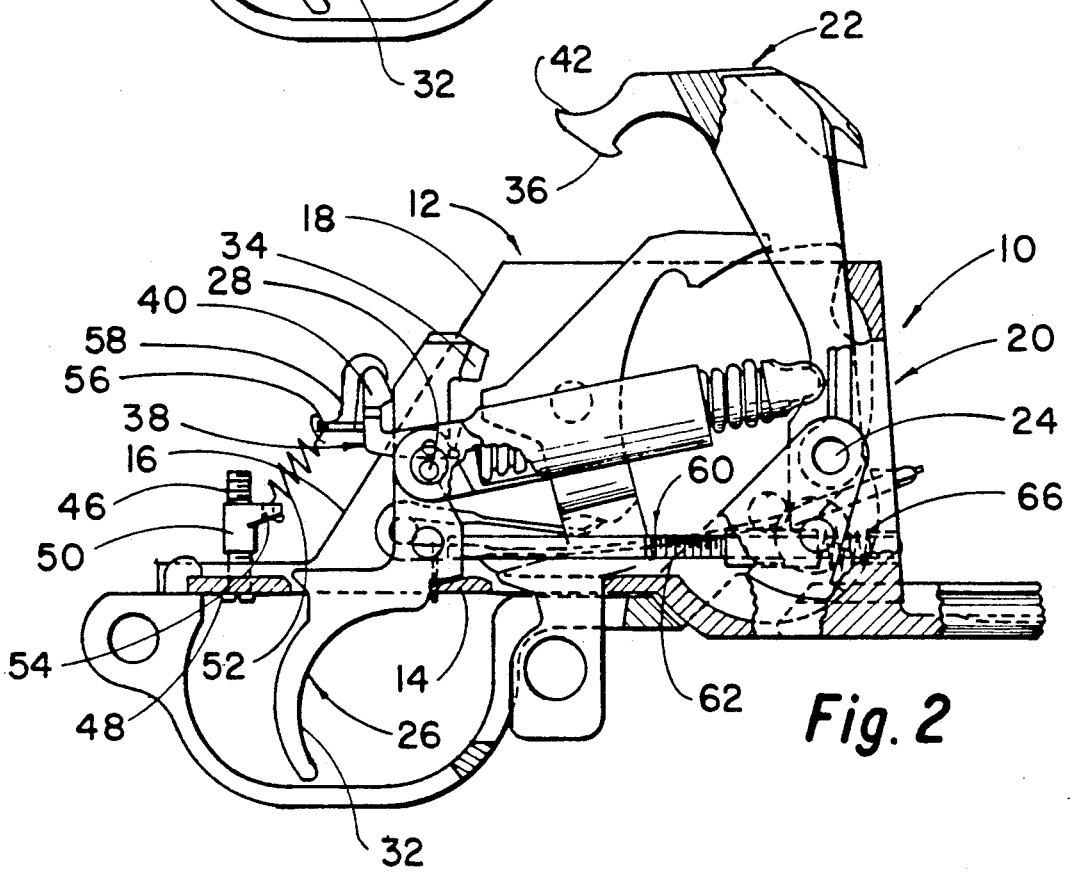
FIG. 2 is a side elevational view, partly in section and partly fragmentary, of a trigger mechanism in fired position, embodying my invention.
Figure 3:
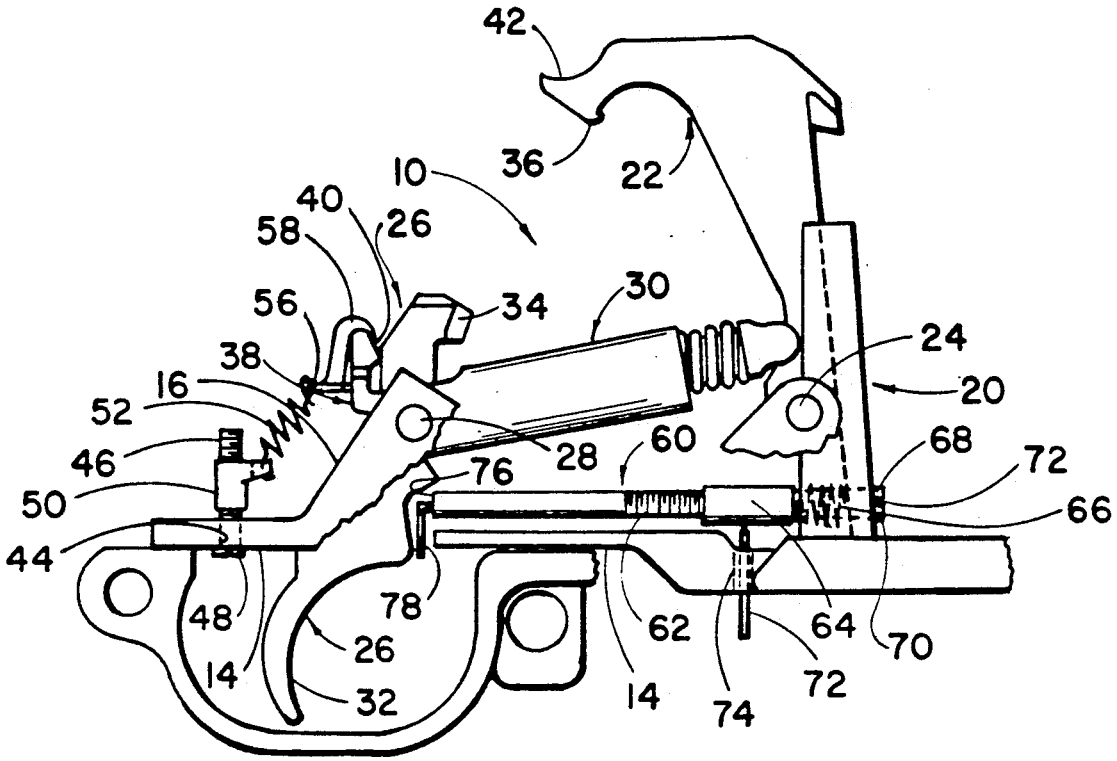
FIG. 3 is a side elevational view, partly fragmentary, of a trigger mechanism in fired position, embodying my invention.
Figure 4:
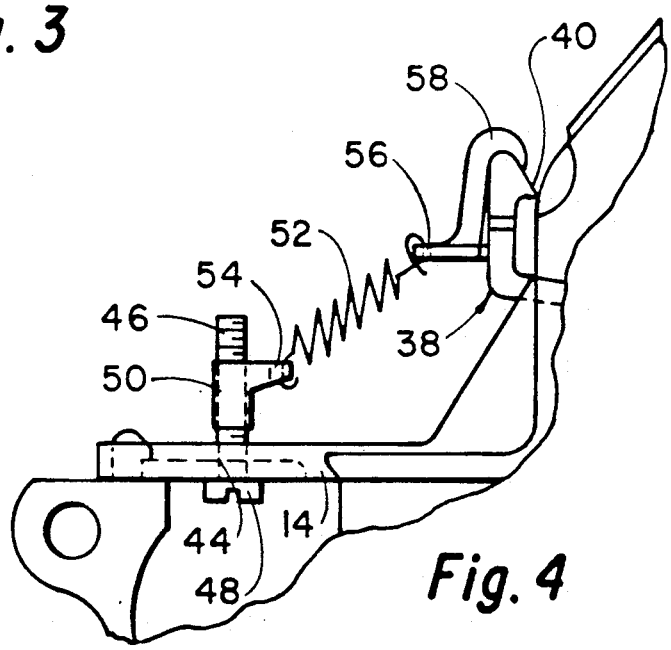
FIG. 4 is a side elevational view of an auxiliary sear adjustment component of my invention in position upon an auxiliary sear of a rifle.
Figure 5:
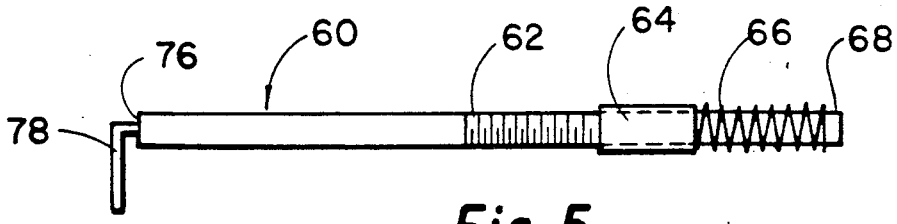
FIG. 5 is a side elevational view of an elongated trigger adjustment component of my invention.

FIG. 1 is a side elevational view, partly in section and partly fragmentary, of a trigger assembly 10, generally, comprising the components known and shown in the Garand M-1 rifle, as for example, are shown by Garand in his U.S. Pat. No. 2,377,338, and with my trigger control mechanism added. In this example of adding my invention to a Garand rifle, I am showing components identical to those shown by Garand, including a trigger housing 12, generally, having a bottom plate 14, ear 16 on the right side of housing 12, left side plate 18 (omitted from my FIG. 3) and a front plate 20, generally. Mounted in these components are a hammer 22, generally, mounted on pivot pin 24, a trigger 26, generally, mounted on pivot pin 28, and a coil spring component 30, generally, also mounted on pivot pin 28, and providing bias against a lower portion of hammer 22.

Trigger 26, generally, includes a finger piece 32 and a main sear 34. Main sear 34 engages a pair of projections 36 on the hammer 22 when the rifle is cocked.

An auxiliary sear 38, generally, is mounted on a pin (not shown) passing through the trigger above pin 28, and has a projection 40, which, as explained by Garand, at proper times, engages a pair of projections 42 on the hammer 22.

I have added the components of my invention as I explained above. The movement of the trigger 26 and auxiliary sear 38 are controllable by my invention.

I have prepared an opening 44 through a rear portion of bottom plate 14, which preferably is threaded, and have extended a bolt 46, threadably through this opening 44. Bolt 46 should have a slot 48 for easy adjustment by use of a screwdriver. A threaded outer member 50 cooperates with bolt 46 for easy adjustment of a coil spring 52 having one end connected to a receptacle 54 and a second end connected to a receptacle 56 at the bottom of a hook member 58 which hooks removably over auxiliary sear 38.

Then, adjacent the lower inside portion of the bottom plate 14 I have provided an elongated spring-biased component 60, generally, which provides a biasing thrust between an inner surface of front plate 20 and front lower face of trigger 26.

As I mentioned above, the front plate 20 is an upright, sturdy member of the trigger assembly to which most of the components of the assembly are attached and given support. As shown in the drawings, this front plate 20 is sufficiently sturdy and stable to stop the forward movement of the hammer.

The elongated member 60 comprises an elongated threaded member 62 having positioned thereon a threaded sleeve 64 which adjustably urges a coil spring 66 against an inner surface of the front plate 20. Coil spring 66 fits loosely over a first end 68 of the member 62 which is not a threaded portion and which moves slidably within an opening 70 in front plate 20. The lengthwise adjustment of the elongated component 60 may be easily accomplished by inserting a sharp-pointed instrument or tool 72 through an opening 74 in the bottom plate 14 which is essentially directly below threaded sleeve 64, and, with the sharp-pointed instrument, causing sleeve 64 to rotate in a chosen direction to increase or decrease tension of the coil spring 66. I show in FIG. 3 how such a sharp-pointed tool 72 may be used. For example, hole 74 may be of 3/16 inch size and be of sufficient size to permit the fine adjustment which may be desired. Fitting loosely within a bore 76 at a second end of elongated member 60 is a pin 78 which has its enlarged portion especially adapted to bear against a front portion of the trigger as I have described above.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. A trigger assembly for a gun, mounted in a housing of the gun, and comprising:
- a trigger pivotally mounted in the housing,
- a hammer pivotally mounted in the housing,
- a spring-biased member mounted in the housing and urging the hammer into a fired position,
- a main sear on the trigger to engage the hammer and hold the hammer in a cocked position,
- an auxiliary sear pivotally mounted on the trigger to engage the hammer and hold the hammer in a cocked position in event the hammer is urged into a cocked position before the trigger is released,
- an adjustable spring-biased member attached to the auxiliary sear to permit adjustment of the biasing of the auxiliary sear, and
- an adjustable elongated spring-biased component positioned longitudinally adjacent a lower side of the housing and having a first end having a spring portion bearing against a front plate and a second end component impinging against a front lower face of the trigger to permit adjustment of trigger movement.

2. A trigger assembly for a gun as described in claim 1, wherein the auxiliary sear is forwardly biased.

3. A trigger assembly for a gun as described in claim 2, wherein the adjustable spring-biased member attached to the auxiliary sear includes:
- a hook member removably positioned upon the auxiliary sear,
- a threaded adapter member positioned in the lower side of the housing, and
- a spring connecting the hook member to the threaded adapter.

4. A trigger assembly for a gun as described in claim 3, wherein the threaded adapter includes:
- a threaded outer member positioned within the housing and a threaded bolt passing through an opening in the housing and received cooperatively in the threaded outer member.

5. A trigger assembly for a gun as described in claim 4, wherein the threaded bolt is adjustable from exterior of the trigger housing.

6. A trigger assembly for a gun as described in claim 5, wherein the adjustable elongated spring-biased component includes:
- a threaded sleeve near the first end,
- a threaded member cooperating with the threaded sleeve to provide for adjustment, and
- the second end component includes a pin member cooperating with the threaded member.

7. A trigger assembly for a gun as described in claim 6, wherein the adjustable elongated spring-biased component includes:
- a coil spring encircling the elongated component near the first end, and the coil spring is bearing against an inner surface of the front plate.

8. A trigger assembly for a gun as described in claim 7, wherein the adjustable elongated spring-biased component includes:
- the first end slidably movable within an opening in the front plate.

9. A trigger assembly for a gun as described in claim 8, wherein the pin member of the adjustable elongated spring-biased component includes:
- an enlarged portion at the second end to permit a larger surface to impinge against the trigger and to provide limited forward movement of the trigger.

10. A trigger assembly for a gun as described in claim 3, wherein the adjustable elongated spring-biased component includes:
- a threaded sleeve near the first end,
- a threaded member cooperating with the threaded sleeve to provide for adjustment, and
- the second end component includes a pin member cooperating with the threaded member.

11. A trigger assembly for a gun as described in claim 10, wherein the adjustable elongated spring-biased component includes:

a coil spring encircling the elongated component near the first end, and the coil spring is bearing against an inner surface of the front plate.

12. A trigger assembly for a gun as described in claim 11, wherein the adjustable elongated spring-biased component includes:

the first end slidably movable within an opening in the front plate.

13. A trigger assembly for a gun as described in claim 12, wherein the pin member of the adjustable elongated spring-biased component includes:

an enlarged portion at the second end to permit a larger surface to impinge against the trigger and to provide limited forward movement of the trigger.

14. A trigger assembly for a gun as described in claim 4, wherein the adjustable elongated spring-biased component includes:

a threaded sleeve near the first end, a threaded member cooperating with the threaded sleeve to provide for adjustment, and the second end component includes a pin member cooperating with the threaded member.

15. A trigger assembly for a gun as described in claim 14, wherein the adjustable elongated spring-biased component includes:

a coil spring encircling the elongated component near the first end, and the coil spring bearing against an inner surface of the front plate.

16. A trigger assembly for a gun as described in claim 15, wherein the adjustable elongated spring-biased component includes:

the first end slidably movable within an opening in the front plate.

17. A trigger assembly for a gun as described in claim 16, wherein the pin member of the adjustable elongated spring-biased component includes:

an enlarged portion at the second end to permit a larger surface to impinge against the trigger and to provide limited forward movement of the trigger.

* * * * *